US008195469B1

(12) United States Patent
Serizawa et al.

(10) Patent No.: US 8,195,469 B1
(45) Date of Patent: Jun. 5, 2012

(54) DEVICE, METHOD, AND PROGRAM FOR ENCODING/DECODING OF SPEECH WITH FUNCTION OF ENCODING SILENT PERIOD

(75) Inventors: Masahiro Serizawa, Tokyo (JP); Hironori Ito, Tokyo (JP)

(73) Assignee: NEC Corporation, Tokyo (JP)

( * ) Notice: Subject to any disclaimer, the term of this patent is extended or adjusted under 35 U.S.C. 154(b) by 1255 days.

(21) Appl. No.: 09/980,275

(22) PCT Filed: May 31, 2000

(86) PCT No.: PCT/JP00/03492

§ 371 (c)(1),
(2), (4) Date: May 16, 2002

(87) PCT Pub. No.: WO00/74036

PCT Pub. Date: Dec. 7, 2000

(30) Foreign Application Priority Data

May 31, 1999 (JP) ..... 11-152380
Oct. 20, 1999 (JP) ..... 11-298795

(51) Int. Cl.
*G10L 19/00* (2006.01)
*G10L 21/04* (2006.01)

(52) U.S. Cl. ..... 704/500; 704/501; 704/502; 704/503; 704/504

(58) Field of Classification Search ..... 704/201, 704/215, 224, 258, 265, 233, 500–504
See application file for complete search history.

(56) References Cited

U.S. PATENT DOCUMENTS 5,537,509 A * 7/1996 Swaminathan et al. ..... 704/228
5,737,695 A * 4/1998 Lagerqvist et al. ..... 455/79
5,774,847 A * 6/1998 Chu et al. ..... 704/237
5,781,881 A * 7/1998 Stegmann ..... 704/211
5,787,388 A * 7/1998 Hayata ..... 704/215
5,794,199 A * 8/1998 Rao et al. ..... 704/258
5,797,120 A 8/1998 Ireton (Continued)

FOREIGN PATENT DOCUMENTS

EP 0 751 490 A2 1/1997

(Continued)

OTHER PUBLICATIONS

Adil Benyassine, et al., "ITU-T Recommendation G.729 Annex B: A Silence Compression Scheme for Use with G.729 Optimized for V.70 Digital Simultaneous Voice and Data Applications," IEEE Communications Magazine, Sep. 1997, pp. 64-73.

(Continued)

*Primary Examiner* — Jialong He
(74) *Attorney, Agent, or Firm* — Dickstein Shapiro LLP

(57) ABSTRACT

A speech decoding device of the invention smoothes, in decoding speech signal in a voice-less period, RMS and filter coefficients which is discontinuously transmitted, and provides them to a synthesis filter. Thereby, it is capable of preventing discontinuous changing of the filter coefficient caused by the intermittent transmission of the filter coefficient. As a result, a quality of decoding can be improved. Also, to remove an effect, caused by the smoothing process, from the filter coefficients or the RMS which are transmitted in the past frames, a smoothing factor is adjusted not to perform smoothing while a certain time period (or a certain number of frames) from when a transition is made from a voice period from a voice-less period, or when a decoded feature parameter satisfies a predetermined condition.

10 Claims, 10 Drawing Sheets

U.S. PATENT DOCUMENTS

| | | | | | |
|---|---|---|---|---|---|
| 5,809,460 | A | * | 9/1998 | Hayata et al. | 704/225 |
| 5,812,965 | A | * | 9/1998 | Massaloux | 704/205 |
| 5,819,218 | A | * | 10/1998 | Hayata et al. | 704/233 |
| 5,835,889 | A | * | 11/1998 | Kapanen | 704/215 |
| 5,893,056 | A | * | 4/1999 | Saikaly et al. | 704/226 |
| 5,943,347 | A | * | 8/1999 | Shepard | 714/747 |
| 5,960,389 | A | * | 9/1999 | Jarvinen et al. | 704/220 |
| 5,978,760 | A | * | 11/1999 | Rao et al. | 704/226 |
| 5,978,761 | A | * | 11/1999 | Johansson | 704/226 |
| 6,011,846 | A | * | 1/2000 | Rabipour et al. | 379/406.06 |
| 6,026,356 | A | * | 2/2000 | Yue et al. | 704/201 |
| 6,202,046 | B1 | * | 3/2001 | Oshikiri et al. | 704/233 |
| 6,269,331 | B1 | * | 7/2001 | Alanara et al. | 704/205 |
| 6,272,459 | B1 | * | 8/2001 | Takahashi | 704/221 |
| 6,275,798 | B1 | * | 8/2001 | Johansson et al. | 704/233 |
| 6,415,253 | B1 | * | 7/2002 | Johnson | 704/210 |
| 6,453,285 | B1 | * | 9/2002 | Anderson et al. | 704/210 |
| 6,453,289 | B1 | * | 9/2002 | Ertem et al. | 704/225 |
| 6,510,409 | B1 | * | 1/2003 | Su | 704/233 |
| 6,597,961 | B1 | * | 7/2003 | Cooke | 700/94 |
| 6,643,618 | B2 | * | 11/2003 | Matsuoka et al. | 704/228 |
| 6,662,155 | B2 | * | 12/2003 | Rotola-Pukkila et al. | 704/228 |
| 6,711,537 | B1 | * | 3/2004 | Beaucoup | 704/220 |

FOREIGN PATENT DOCUMENTS

| | | |
|---|---|---|
| JP | 60-262200 | 12/1985 |
| JP | 62-102300 | 5/1987 |
| JP | 62-253200 | 11/1987 |
| JP | 7-248793 | 9/1995 |
| JP | 7-261797 | 10/1995 |
| JP | 7-334197 | 12/1995 |
| JP | 8-305398 | 11/1996 |
| JP | 9-149104 | 6/1997 |
| JP | 09-244695 | 9/1997 |
| JP | 10-39898 | 2/1998 |
| JP | 10-83200 | 3/1998 |
| JP | 11-98090 | 4/1999 |
| JP | 2000-267700 | 9/2000 |
| JP | 2001-249698 | 9/2001 |

OTHER PUBLICATIONS

Manfred R. Schroeder et al, "Code-Excited Linear Prediction (CELP): High-Quality Speech at Very Low Bit Rates," IEEE, 1985, pp. 937-940.

ITU-T "General Aspects of Digital Transmission Systems," Mar. 1996, G.729, pp. 1-35.

Japanese Office Action dated Jan. 7, 2003 (and English translation of relevant portion).

European Supplementary Search Report dated Jun. 29, 2005.

* cited by examiner

DEVICE, METHOD, AND PROGRAM FOR ENCODING/DECODING OF SPEECH WITH FUNCTION OF ENCODING SILENT PERIOD

TECHNICAL FIELD

The invention relates to a device for encoding/decoding of digital information such as a speech signal, in particular, to a technique for encoding/decoding of a voice-less period.

BACKGROUND ART

Conventionally, some devices are proposed to reduce an average bit rate of transmission of a speech signal in a voice-less period (a period with no voice), by encoding a speech signal at lower bit rates than that used to encode a speech signal in a period with a voice. For example, the technique is disclosed in a document 1 (IEEE Communication Magazine, pages 64-73, September 1997).

The conventional encoding device determines whether the input signal includes a voice or not, for each frame with a predetermined size, e.g. 10 milliseconds, and if the signal in the frame includes a voice, the signal is encoded and decoded in a general speech coding method.

On the other hand, the input signal includes no voice, the conventional coding device discontinuously encodes feature parameters of the input speech signal and transmits the encoded parameters to a decoding device. Herein, the decoding device smoothes the feature parameters discontinuously received, and decodes a speech signal by using the smoothed parameters.

A method of determining whether the speech signal is voice-less or not for each frame, is also disclosed in the document 1. In the method, a root means square value (hereinafter, referred to as "RMS") computed from an input speech signal for each frame, an RMS corresponding to a low frequency region, the number of zero crossing, and filter coefficients representing spectral envelope characteristics are used.

The determination is done by comparing these values in each frame with the predetermined thresholds.

A method of encoding a speech signal in a period with voice is, for example, disclosed as CELP method (Code Excited Linear Prediction Coding method) in a document 2 (ITU-T recommendation G.729, July, 1995).

The CELP method is disclosed in a document 3 (Code-Excited Linear Prediction: High Quality Speech at Very Low Bit Rates (IEEE Proc. ICASSP-85, pp. 937-940, 1985)).

In an encoding process of a conventional coding device, first, speech signal is inputted frame by frame and is processed with linear predictive analysis to obtain linear predictive (LP) coefficients representing spectral envelope characteristics of a speech, and an excitation signal for driving an LP synthesis filter corresponding to the spectral envelope characteristics is derived to be encoded.

Further, in an encoding process of the excitation signal, each frame is divided into subframes and encoding of the excitation signal is performed for each subframe. Herein, the excitation signal is composed of a pitch element representing a pitch period of the input signal, a residual element, and gains of these elements. The pitch element is denoted as an adaptive codevector which is stored in a codebook, which is referred to as "adaptive codebook", and includes the past excitation signal. The residual element is denoted as a multipulse signal composed of a plurality of pulses.

Also, in a decoding process, to decode a speech signal, an excitation signal derived by decoding the pitch element and the residual element is fed into a synthesis filter composed of decoded filter coefficients.

In a method of encoding a speech signal in a voice-less period, as described in the document 1, first, an RMS and filter coefficients calculated from the speech are encoded at a coding device. Then, at a decoding device, a multipulse signal and a random signal are generated so that a root mean square of a sum of them is equal to the decoded RMS, and the sum of them is fed to a synthesis filter composed using the decoded filter coefficients to decode a speech signal in a voice-less period.

In a voice-less period, the feature parameters are transmitted only in frames that characteristics of the signal changes, otherwise nothing is transmitted. However, information showing whether the feature parameters is transmitted or not is sent in another way.

When the feature parameters are not transmitted, the output speech signal is decoded by repeatedly using the past transmitted feature parameters. Smoothed RMS is used for decoding not to cause a discontinuity of a waveform of the decoded speech signal.

FIG. 8 shows a block diagram representing a structure of a conventional encoding device. Referring to FIG. 8, the encoding device includes a voice part coding circuit 12, a voice-less part coding circuit 14, a signal determining circuit 16, a switching circuit 18, and a bit sequence generating circuit 20.

A speech signal is inputted frame by frame, for example, in 10 milliseconds unit by an input terminal 10. The signal determining circuit 16 determines whether the speech signal from the input terminal 10 is a period with voice or a voice-less period for each frame, and passes the determining result (VAD determination sign) to the switching circuit 18 and a bit sequence generating circuit 20.

The voice part coding circuit 12 encodes the speech signal from the input terminal 10 for each frame, and passes the encoded signal to the switching circuit 18.

The voice-less part coding circuit 14 encodes the speech signal from the input terminal 10 for each frame, and passes the encoded signal to the switching circuit 18. Further, the voice-less part coding circuit 14 sends determination information (DTX determination sign) indicating whether the encoded signal is transmitted in the voice-less period, to the bit sequence generating circuit 20.

The switching circuit 18 operates based on the VAD determination sign received from the signal determining circuit 16. When the circuit 18 receives the sign indicating a voice period, the encoded signal passed from the voice part coding circuit 12 is sent to the bit sequence generating circuit 20. On the other hand, when the circuit 18 receives the sign indicating a voice-less period, the encoded signal passed from the voice-less part coding circuit 14 is sent to the bit sequence generating circuit 20.

The bit sequence generating circuit 20 multiplexes the VAD determination sign from the signal determining circuit 16, the DTX determination sign from the voice-less part coding circuit 10, and encoded signal from the switching circuit 18, to generate bit sequence and outputs the bit sequence from an output terminal 22.

FIG. 9 shows a block diagram for explaining a conventional decoding device.

Referring to FIG. 9, the decoding device includes a bit sequence decomposing circuit 26, a switching circuit 28, a voice part decoding circuit 30, and a voice-less part decoding circuit 34.

The bit sequence decomposing circuit 26 decomposes a bit sequence inputted from an input terminal 24 into the VAD determination sign, the DTX determination sign, and the encoded signal. And then, the circuit 26 sends the VAD determination sign and the encoded signal to the switching circuit 28, and sends the DTX determination sign to the voice-less part decoding circuit 34.

The switching circuit 28 operates based on the VAD determination sign received from the bit sequence decomposing circuit 26. When the circuit 28 receives the sign indicating a voice period, the encoded signal passed from the bit sequence decomposing circuit 26 is sent to the voice part decoding circuit 30. On the other hand, when the circuit 28 receives the sign indicating voice-less period, the encoded signal passed from the bit sequence decomposing circuit 26 is sent to the voice-less part decoding circuit 34.

The voice part decoding circuit 30 decodes the encoded signal passed from the switching circuit 28 and outputs the decoded signal from an output terminal 32.

The voice-less part decoding circuit 34 decodes the encoded signal passed from the switching circuit 28 by using the DTX determination sign from the bit sequence decomposing circuit 26, and outputs the decoded signal from an output terminal 32.

FIG. 10 shows a block diagram representing a voice-less part decoding circuit 34 of a conventional decoding device. Referring to FIG. 10, the voice-less part decoding circuit 34 includes a parameter decoding circuit 54, a random circuit 56, a pulse circuit 53, a pitch circuit 58, a mixing circuit 61, a smoothing circuit 66, and a synthesis circuit 68.

The parameter decoding circuit 54 decodes filter coefficients and an RMS from the encoded signal inputted from an input terminal 52, and sends the filter coefficients and the RMS to the synthesis circuit 68 and the smoothing circuit 66, respectively.

The smoothing circuit 66 receives the RMS from the parameter decoding circuit 54, and smoothes the RMS. And then the circuit 66 passes the smoothed RMS to the mixing circuit 61. However, if it is found that the encoded signal is not transmitted through the DTX determination sign from an input terminal 50, the circuit 66 calculates the smoothed RMS by smoothing the RMS values of the past frames.

Herein, a smoothed RMS P(n) which is used in the n-th frame in a voice-less period is calculated by using the following equation (1) with the RMS p(n) received in the n-th frame. However, when no encoded signal is transmitted, the RMS of the previous frame is used in the equation (1) instead of p(n).

$$P(n)=(1-\alpha)\cdot P(n-1)+\alpha\cdot p(n) \quad (1)$$

Herein, $\alpha$ is a smoothing factor for determining a degree of smoothing, in the above-mentioned document 1, a fixed value 0.125 is set. Further, P(−1) is equal to zero.

The random circuit 56 generates a random signal and passes the random signal to the mixing circuit 61. The pulse circuit 53 generates a multipulse signal composing of a plurality of pulses, each of which has a location and an amplitude determined based on each random number, and passes the multipulse signal to the mixing circuit 61.

The pitch circuit 58 generates a pitch signal q(i) composed of the above-mentioned adaptive codevector, and passes it to the mixing circuit 61. Since a pitch period used to define the adaptive codevector is not transmitted, a random number is used instead.

The mixing circuit 61 computes an excitation signal x(i) to be fed into a synthesis filter by performing the linear sum of the random signal r(i) from the random circuit 56, the multipulse signal p(i) from the pulse circuit 53, and the pitch signal q(i) from the pitch circuit 58, and the result of the computation is sent to the synthesis circuit 68.

A method can be used of computing coupling coefficients of the linear sum as described in the document 1.

In the method, first, a coupling coefficient of the pitch signal Gq is selected from a limited range of values according to a random number.

Next, using the Gq, a coupling coefficient of the multipulse signal Gp is calculated so that the RMS derived from the linear sum of the pitch signal and the multipulse signal is equal to the smoothed RMS.

Using thus calculated Gq and Gp, the linear sum of the pitch signal and the multipulse signal e(i) is calculated according to the following equation (2).

$$e(i)=Gq-q(i)+Gp\cdot p(i) \quad (2)$$

Furthermore, a coupling coefficient of the linear sum of e(i) and the random signal r(i), Gr(i) and $\gamma$, is computed so that the RMS derived form the linear sum of the e(i) and r(i) is equal to the smoothed RMS. Herein, as a coupling coefficient of the random signal, a fixed value, $\gamma$=0.6 is used.

Therefore, the excitation signal to be fed into the synthesis filter, x(i), is computed according to the following equation (3).

$$x(i)=Gr-[Gq\cdot q(i)+Gp-p(i)]+\gamma\cdot r(i) \quad (3)$$

The synthesis circuit 68 decodes the encoded signal by feeding the excitation signal passed from the mixing circuit 61 to a synthesis filter composed of the filter coefficients passed from the parameter decoding circuit 54. Then, the circuit 68 outputs the decoded speech signal from an output terminal 70.

However, the above-mentioned conventional device includes the following problems.

The first problem is that there may be a case where filter coefficients used to decode a speech signal in a voice-less period changes discontinuously at a decoding device, and therefore, degradation of a quality of decoded signal occurs.

That reason is because discontinuously transmitted filter coefficients are used as they are.

The second problem is that a decoding process in the beginning period (for example, several hundreds of milliseconds) in a voice-less period may be influenced by a voice period right before the voice-less period, and consequently an amplitude of the decoded signal is increased over the actual amplitude or degradation of speech quality of the decoded signal occurs, for example, due to existence of echoed sound.

That reason is because a smoothing process of the RMS is always performed in a voice-less period to prevent decoded (reproduced) signals in the voice-less period from being discontinuous.

The third problem is that decoded signal in a voice-less period is remarkably different from a background noise of input speech signal in hearing the decoded signal, and as a result, discontinuous auditory impression is given between the background noise included in the voice-less period and a background noise in a voice period.

That reason is because a fixed value is used as a ratio of a pulse element and a pitch element to a random element, in generating an excitation signal to be fed into the synthesis filter in a voice-less period.

Therefore, the invention is considering the problems. It is a main object of the invention to encode a speech signal in a voice-less period in a high performance, and to provide a device which realizes a high coding quality even if an average transmission bit rate is decreased to encode a speech signal in a voice-less period.

It is another object of the invention to provide a decoding device which can reduce a degradation of the speech quality due to discontinuity of the filter coefficients in decoding a speech signal in a voice-less period.

DISCLOSURE OF THE INVENTION

According to a first aspect of the invention to realize the objects, a speech decoding device is provided, which changes a decoding operation of a speech signal according to whether the speech signal is in a voice period or in a voice-less period in each frame, and which selects feature parameters representing spectral envelope characteristics of the speech signal to be decoded from the feature parameters, smoothes the selected feature parameters in a time direction, and decodes the speech signal by using the smoothed feature parameters.

According to a second aspect of the invention, a speech decoding device is provided which changes a decoding operation of a speech signal according to whether the speech signal is in a voice period or in a voice-less period in each frame, and which decodes the speech signal by using a value, which is obtained by smoothing, in a time direction, at least one of the feature parameters according to an elapsed time from a time point when a transition occurs from the voice period to the voice-less period.

According to a third aspect of the invention, a speech decoding device is provided which changes a decoding operation of a speech signal according to whether the speech signal is in a voice period or in a voice-less period in each frame, and which decodes the voice signal by using a value, which is obtained from at least one of the received feature parameters as it is in a certain time period immediately after changing from the voice period to the voice-less period, and obtained by smoothing at least one of the feature parameters in a time period after the certain time period.

According to a fourth aspect of the invention, a speech decoding device is provided which changes a decoding operation of a speech signal according to whether the speech signal is in a voice period or in a voice-less period in each frame, and which decodes the speech signal by using a value, which is obtained by smoothing at least one of the feature parameters according to the feature parameters.

According to a fifth aspect of the invention, a speech decoding device is provided which changes a decoding operation of a speech signal according to whether the speech signal is in a voice period or in a voice-less period in each frame, and which decodes the speech signal by using a value, which is obtained by smoothing, in a time direction, at least one of the feature parameters according to at least one of the feature parameters and an elapse time from when a transition is made from a voice period to a voice-less period.

According to a fifth aspect of the invention, a speech decoding device is provided which changes a decoding operation of a speech signal according to whether the speech signal is in a voice period or in a voice-less period in each frame, and which decodes the speech signal by using a value, which is obtained from at least one of the feature parameters as it is when the feature parameter satisfies a predetermined condition, and obtained by smoothing, in a time direction, at least one of the feature parameters after the condition is not satisfied.

According to a sixth aspect of the invention, a speech decoding device is provided which changes a decoding operation of a speech signal according to whether the speech signal is in a voice period or in a voice-less period in each frame, and which decodes the speech signal by using a value which is obtained by smoothing, in a time direction, at least one of the feature parameters according to an elapsed time from when a transition is made from a voice period to a voice-less period.

According to a seventh aspect of the invention, a speech decoding device is provided which changes a decoding operation of a speech signal according to whether the speech signal is in a voice period or in a voice-less period in each frame, and which decodes the speech signal by using a value, which is obtained from at least one of the feature parameters as it is when the feature parameter satisfies a predetermined condition and immediately after a transition is made from a voice period to a voice-less period, otherwise, obtained by smoothing, in a time direction, at least one of the feature parameters.

According to an eighth aspect of the invention, a speech decoding device is provided, which changes a decoding operation of a speech signal according to whether the speech signal is in a voice period or in a voice-less period in each frame, and which generates the a speech signal in a part of a voice-less period by feeding an excitation signal composed of plural types of signals, and determines coefficients used to perform a sum operation of the plural types of signals according to at least one of the received feature parameters.

According to a ninth aspect of the invention, a speech decoding device is provided, which changes a decoding operation of the speech signal according to whether the speech signal is in a voice period or in a voice-less period in each frame, and which generates a speech signal in a voice-less period by feeding an excitation signal composed of plural types of signals, and determines, in a part of the period, a coefficient used to perform a sum operation of the plural types of signals according to at least one of the feature parameters smoothed in a time direction.

According to a tenth aspect of the invention, in the speech decoding device of the above the first aspect to the ninth aspect, the feature parameter includes at least one of a quantity representing spectral envelope of the signal to be decoded and a quantity representing power of the signals to be decoded.

According to an eleventh aspect of the invention, a coding device which determines whether the speech signal is in a voice period or in a voice-less period in each frame, and encodes a feature parameter of the speech signal is incorporated with the voce decoding device of the first aspect to the tenth aspect.

BEST MODE FOR EMBODYING THE INVENTION

Figure 9:
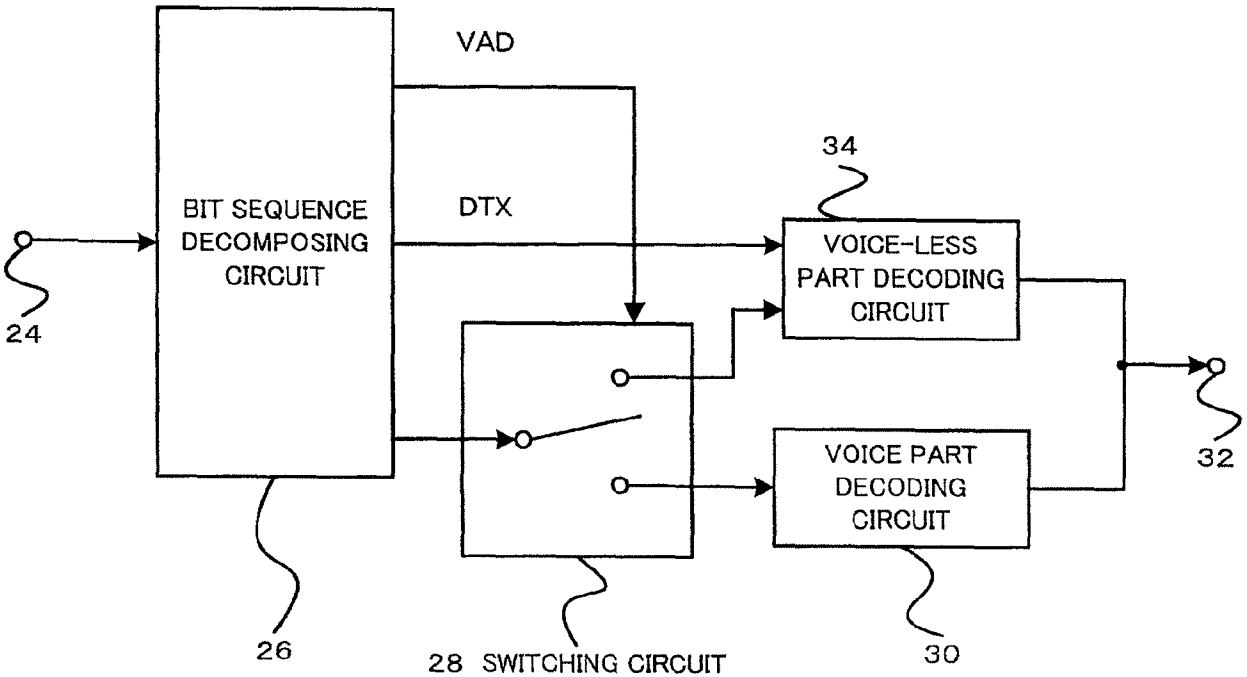
FIG. 9 PRIOR ART
FIG. 9 shows a diagram of a structure of a conventional decoding device.

Description is made about embodiments of the invention. A speech decoding device according to a first embodiment of the invention includes a switching device (shown in FIG. 9 (28)), a smoothing device (shown in FIG. 1 (64)), and a group of decoding devices (shown in FIG. 1 (56, 53, 58, 61, and 68)).

The switching device switches the method of decoding the signal by using the feature parameters of the encoded signal to be decoded, according to determination information representing whether the encoded signal is in a voice period or in a voice-less period for each frame. The smoothing device smoothes the feature parameters representing spectral envelope characteristics of the encoded signal. The group of decoding devices decodes the encoded signal by using the smoothed feature parameters.

Figure 2:
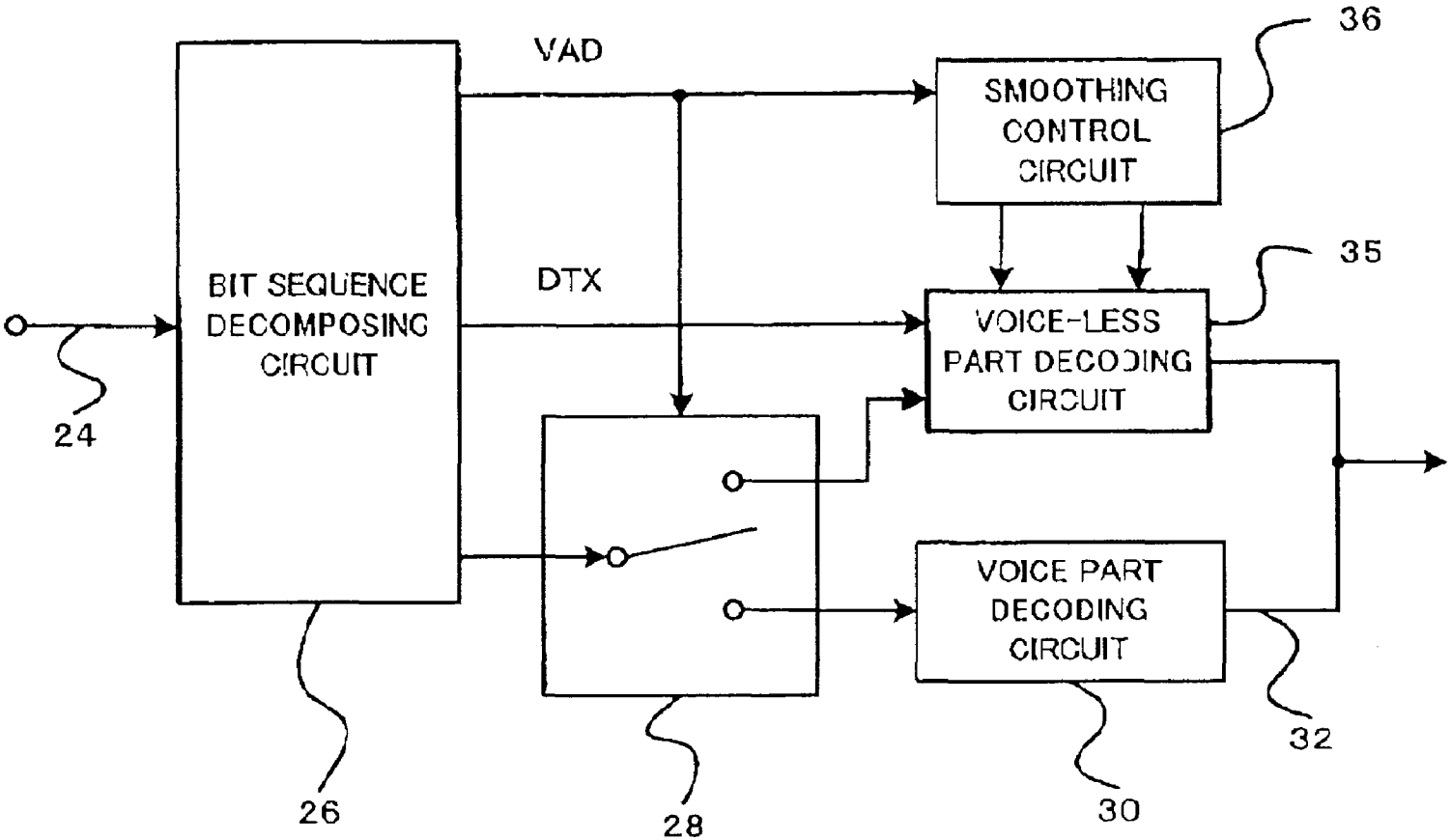
FIG. 2 shows a diagram of a structure of a decoding device according to a second embodiment of the invention.
Figure 3:
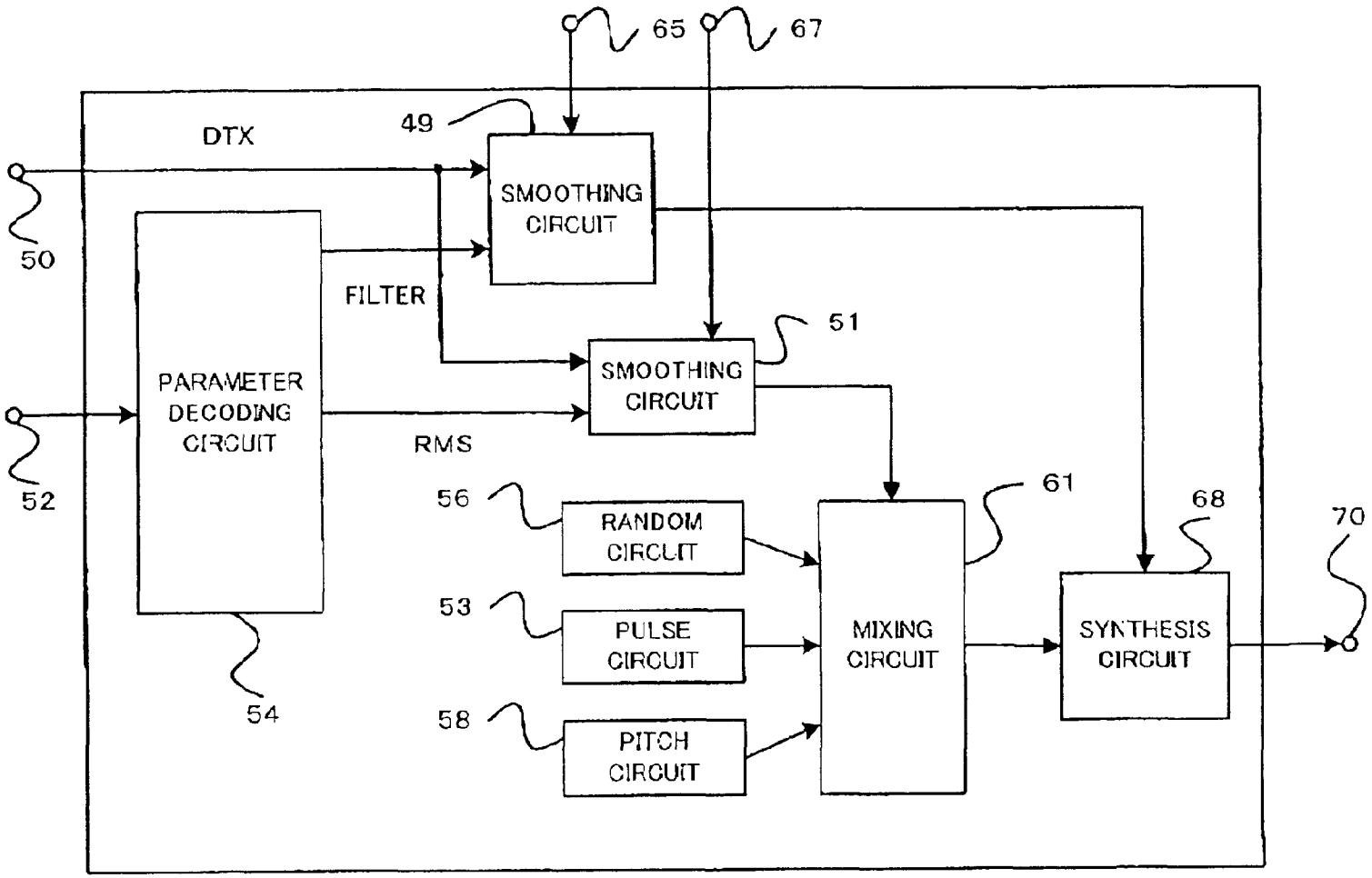
FIG. 3 shows a diagram of a structure of a voice-less part decoding circuit according to a second embodiment of the invention.

A speech decoding device according to a second embodiment of the invention includes a switching device (shown in FIG. 2 (28)), a group of smoothing devices (shown in FIG. 2 (36) and FIG. 3 (49 and 51)), and a group of decoding devices (shown in FIG. 3 (56, 53, 58, 61, and 68)).

The switching device switches the method of decoding the signal by using the feature parameters of encoded signal to be decoded, according to determination information representing whether the encoded signal is in a voice period or in a voice-less period for each frame. The group of smoothing devices smoothes at least one parameter in the feature parameters, based on the parameters and an elapsed time from a time point when a voice period is changed to a voice-less period. The group of decoding devices decodes the encoded signals by using the smoothed feature parameters.

A speech decoding device according to a third embodiment of the invention includes a switching device (shown in FIG. 2 (28)), a group of smoothed value generating devices (shown in FIG. 2 (36) and FIG. 3 (49 and 51)), and a group of decoding devices (shown in FIG. 3 (56, 53, 58, 61, and 68)).

The switching device switches methods of decoding the signal by using feature parameters of encoded signals to be decoded, according to determination information representing whether the encoded signal is in a voice period or in a voice-less period for each frame. The group of smoothed value generating devices set the original value of at least one of transmitted feature parameters as a smoothed value immediately after transition from a voice period to a voice-less period and when a feature parameter satisfies predetermined conditions, and thereafter, generate a smoothed value by smoothing at least one of the feature parameters. The group of decoding devices decodes the encoded signals by using the smoothed parameters.

Figure 4:
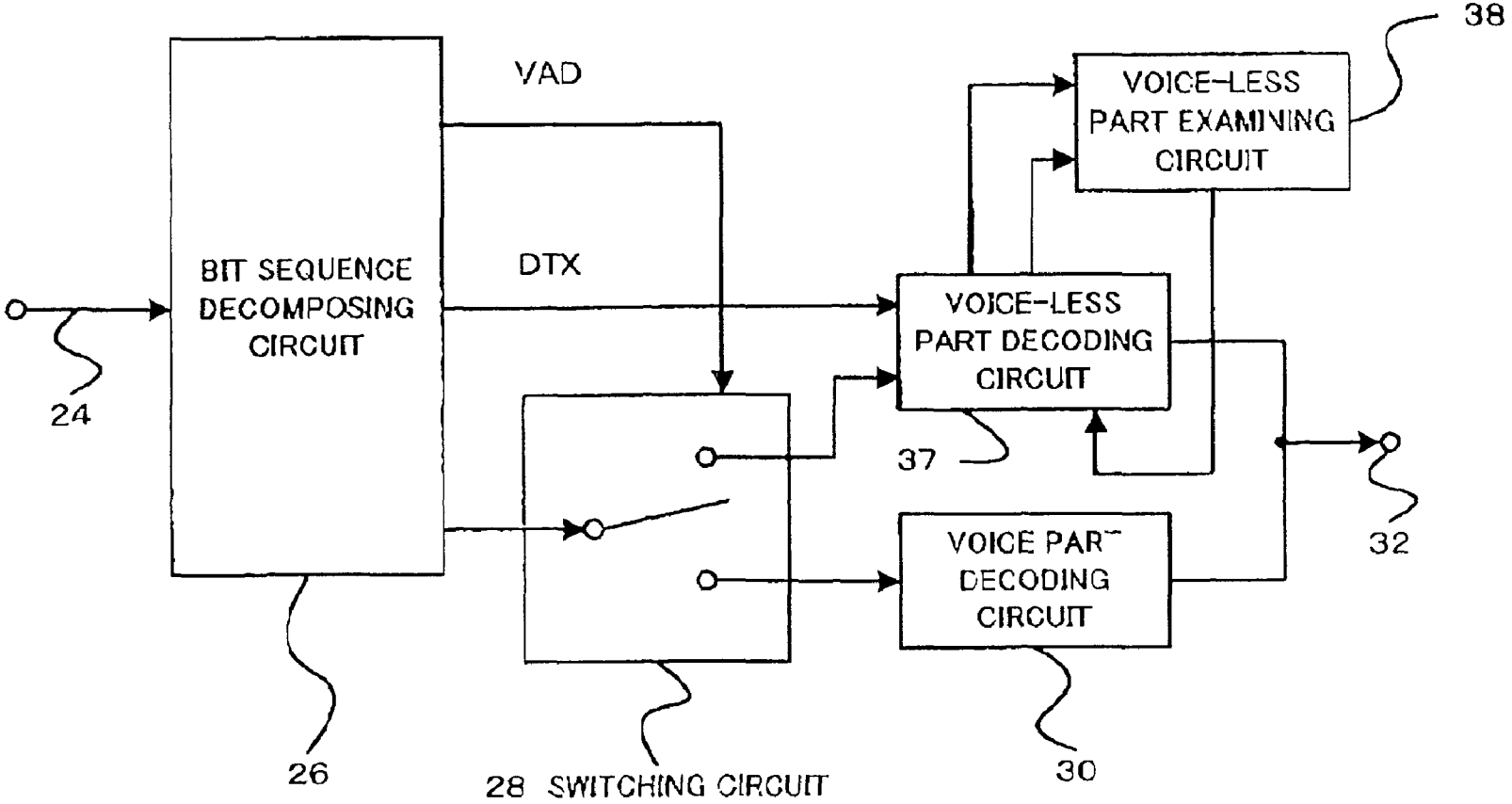
FIG. 4 shows a diagram of a structure of a decoding device according to a third embodiment of the invention.
Figure 5:
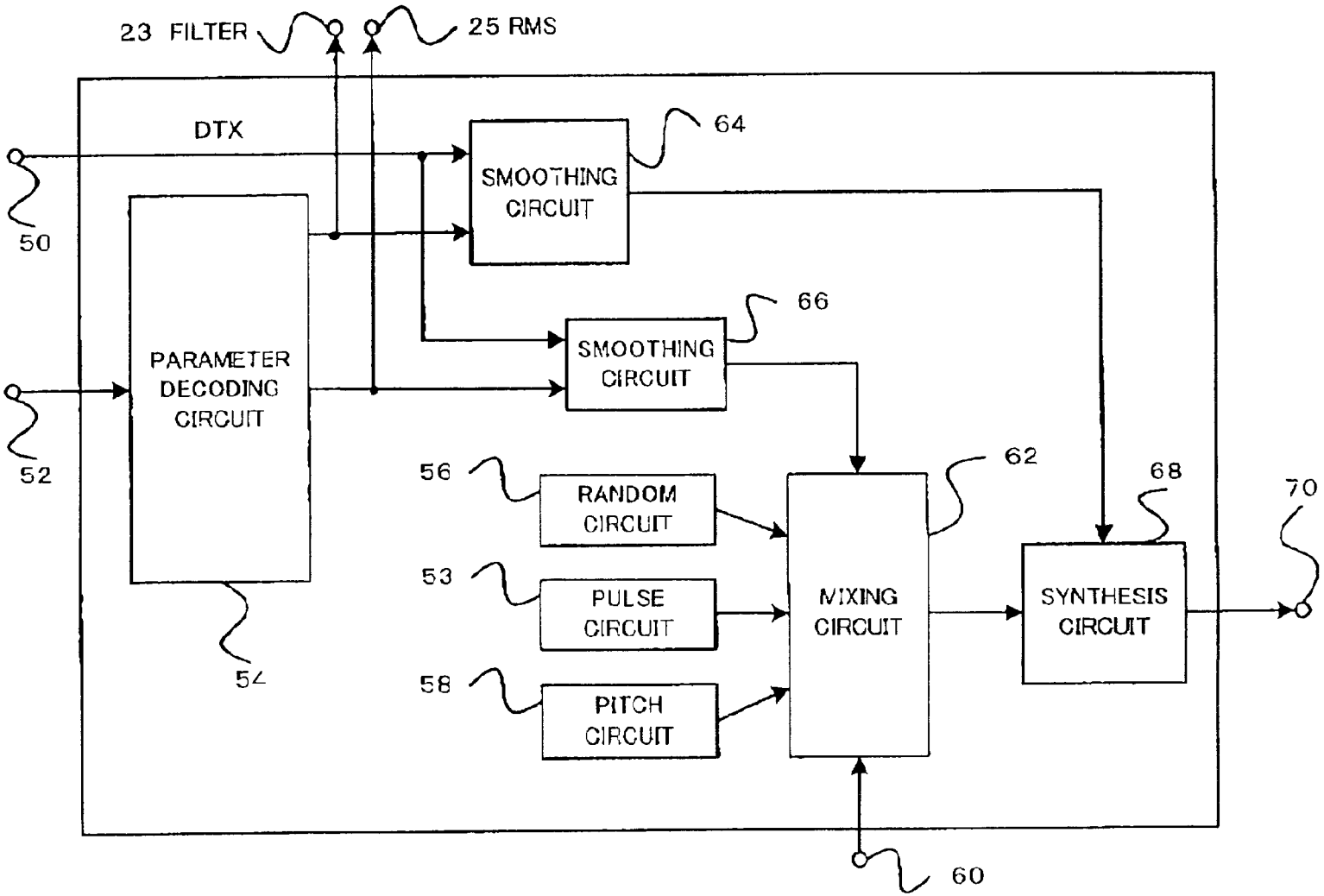
FIG. 5 shows a diagram of a structure of a voice-less part decoding circuit according to a third embodiment of the invention.

A speech decoding device according to a fourth embodiment of the invention includes a switching device (shown in FIG. 4 (28)), a group of signal generating devices (shown in FIG. 5 (56, 53, 58, 60, and 68)), and a coefficient determining device (shown in FIG. 5 (38)).

The switching device switches the method of decoding the signal by using the feature parameters of encoded signals to be decoded, according to determination information representing whether the encoded signal is in a voice period or in a voice-less period for each frame. The group of signal generating devices generates a decoded signal of a voice-less period by feeding an excitation signal composed of plural types of signals into a synthesis filter. The coefficient determining device determines coefficients used to mix plural types of signals in the voice-less period according to at least one of the received feature parameters.

Figure 6:
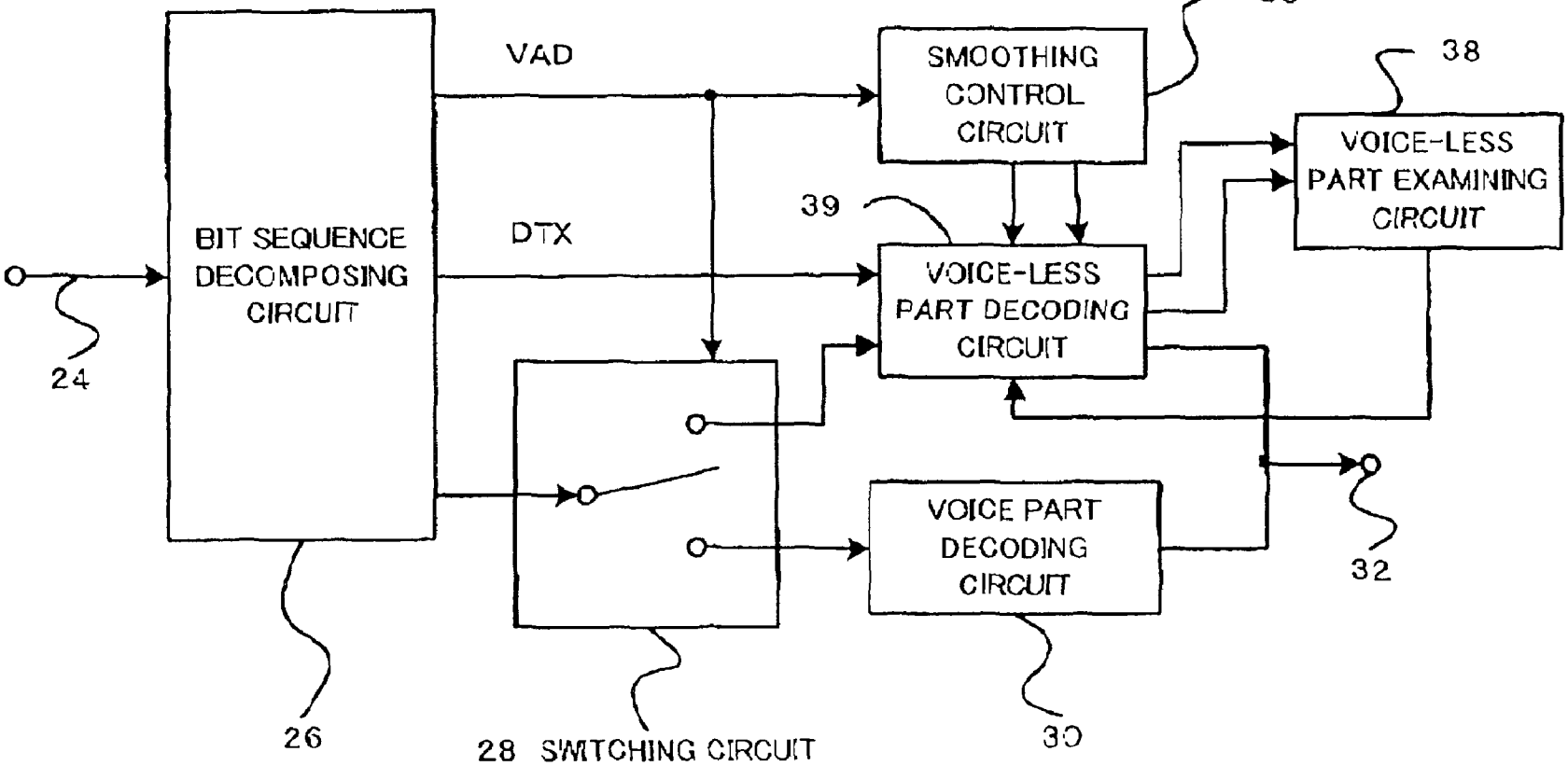
FIG. 6 shows a diagram of a structure of a decoding device according to a fourth embodiment of the invention.
Figure 7:
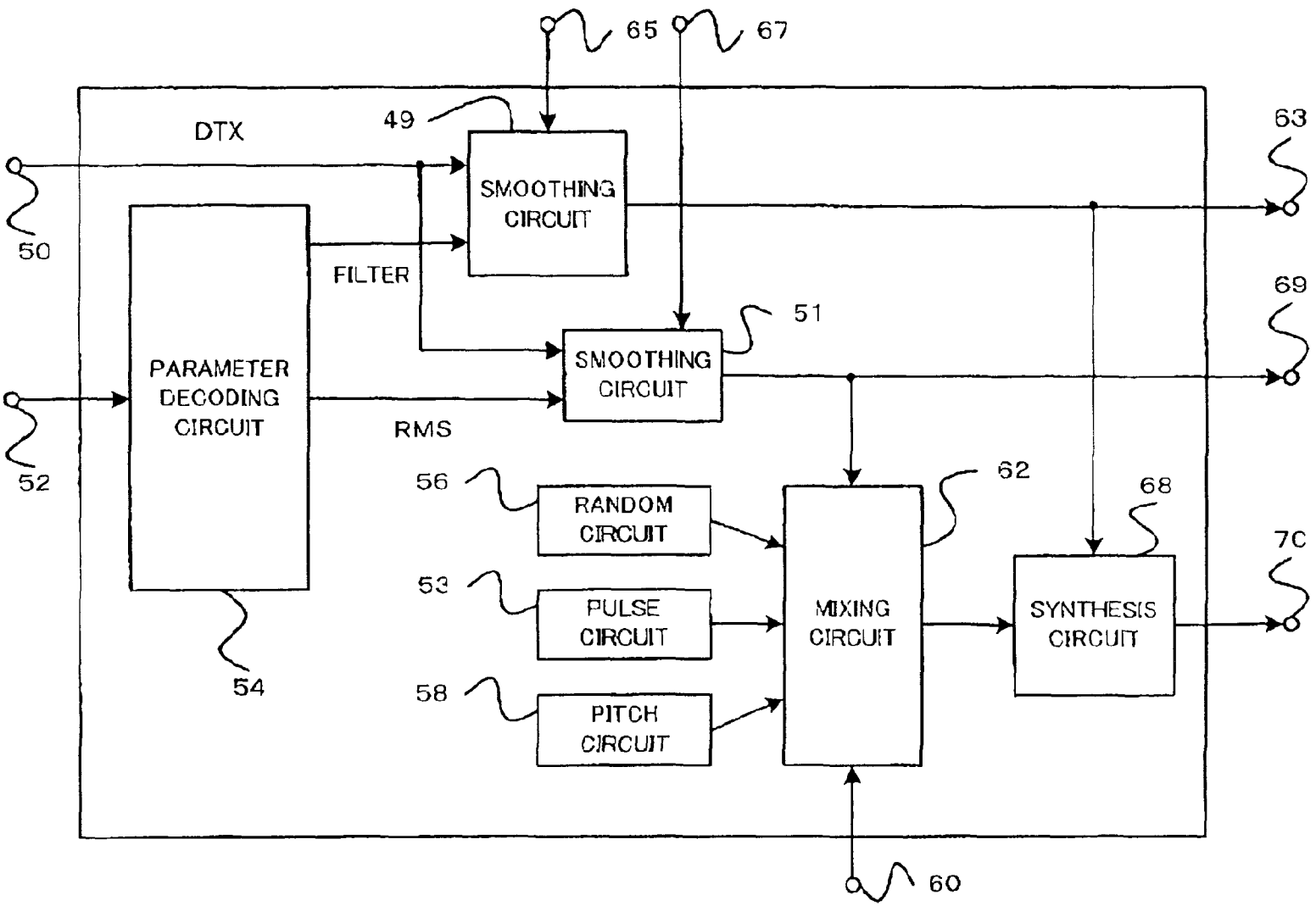
FIG. 7 shows a diagram of a structure of a voice-less part decoding circuit according to a fourth embodiment of the invention.

A speech decoding device according to a fifth embodiment of the invention includes a switching device (shown in FIG. 6 (28)), a group of signal generating devices (shown in FIG. 7 (56, 53, 58, 62, and 68)), a group of parameter calculating devices (shown in FIG. 7 (49 and 51), and a coefficient determining device (shown in FIG. 6 (38)).

The switching device switches methods of decoding signals by using feature parameters of encoded signals to be decoded, according to determination information representing whether the encoded signal is in a voice period or in a voice-less period for each frame. The group of signal generating devices generates a signal of a voice-less period by feeding an excitation signal composed of plural types of signals into a synthesis filter. The group of parameter calculating devices calculates a smoothed parameter by smoothing the received feature parameters. The coefficient determining device determines coefficients used to mix plural types of signals in the voice-less period according to at least one of the calculated feature parameters.

In a speech decoding device according to a sixth embodiment of the invention, the feature parameters include at least one of a value representing the spectral envelope of the signals to be decoded and a value representing a power of the signals.

Figure 8:
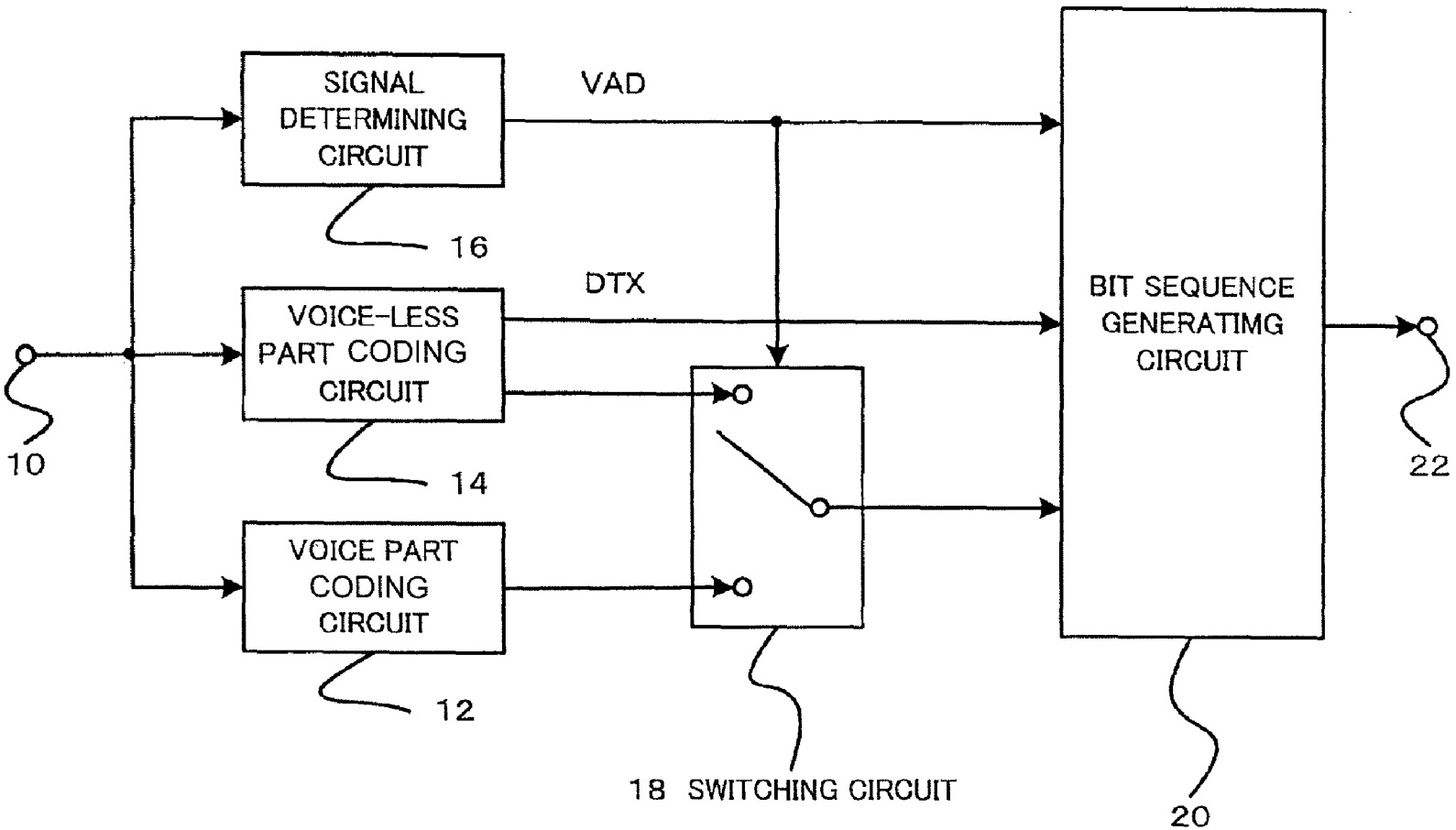
FIG. 8 shows a diagram of a structure of a coding device according to a conventional device and the invention.

A preferred embodiment of a encoding/decoding device according to the invention includes a encoding device (shown in FIG. 8) which determines whether the input signal is in a voice period or in a voice-less period for each frame and encodes feature parameters of the input signal, and a speech decoding device according to one of the devices shown in the first embodiment to the sixth embodiment.

Description is made about an operation and a principle of an embodiment of the invention.

According to the invention, the speech decoding device smoothes a discontinuously transmitted filter coefficients with the RMS, and uses the coefficients about a synthesis filter, in decoding a speech signal in a voice-less period. Thereby, a discontinuous change of the filter coefficients can be prevented which is caused due to the discontinuous transmission of the filter coefficients, and as a result, a voice quality of the decoded signal can be improved.

In the speech decoding device, when the filter coefficients and the RMS which are smoothed in a voice-less period are currently used, the filter coefficients and the RMSs of the past frames influence the currently used filter coefficients and the RMS because of the smoothing process.

Since the signal in the beginning of the voice-less period includes characteristics of a voice period immediately before the voice-less period, the signal in the voice-less period is decoded by using the feature parameters including the characteristics of the voice period. Consequently, an amplitude of a waveform of the decoded signal become larger than an actual amplitude of the input speech signal, or degradation of the decoded speech signal, such as an existence of echo in the decoded signal, may occur.

To prevent them, when a predetermined time elapses or a certain number of frames are received from a time point of the transition from a voice period to a voice-less period, for example, a smoothing factor is set not to perform smoothing process when a value of the RMS representing an amplitude of the decoded speech is still larger than a predetermined value. Thereby, in the beginning of the voice-less period, an effect from the voice period immediately before the voice-less period, due to smoothing of the feature parameter can be reduced.

There may be the auditory difference between a background noise included in the signal decoded in a voice part decoding circuit and the signal decoded in a voice-less part decoding circuit, in a case where background noises are included in the input signal. This reason is that the voice-less part decoding circuit computes an excitation signal to be fed into a synthesis filter, on only condition that the RMS of the signal becomes equal to a smoothed value of the transmitted RMS.

In the invention, it is capable of reducing degradation of the decoded speech quality due to the auditory difference, by determining how to compute the excitation signal considering characteristics of the input signal. To consider the characteristics, for example, a random noise signal is mainly used when the smoothed RMS is small, on the other hand, a pulse signal or a pitch signal is mainly used when the smoothed RMS is large or when the spectrum computed from the filter coefficients are not flat.

Description is made in more detail about embodiments of the invention with reference to the drawings. A basic structure of an encoding device used in the embodiments is similar to the structure of the coding device shown in FIG. 8. Also, a basic structure of the decoding device is similar to the structure of the decoding device shown in FIG. 9.

Figure 1:
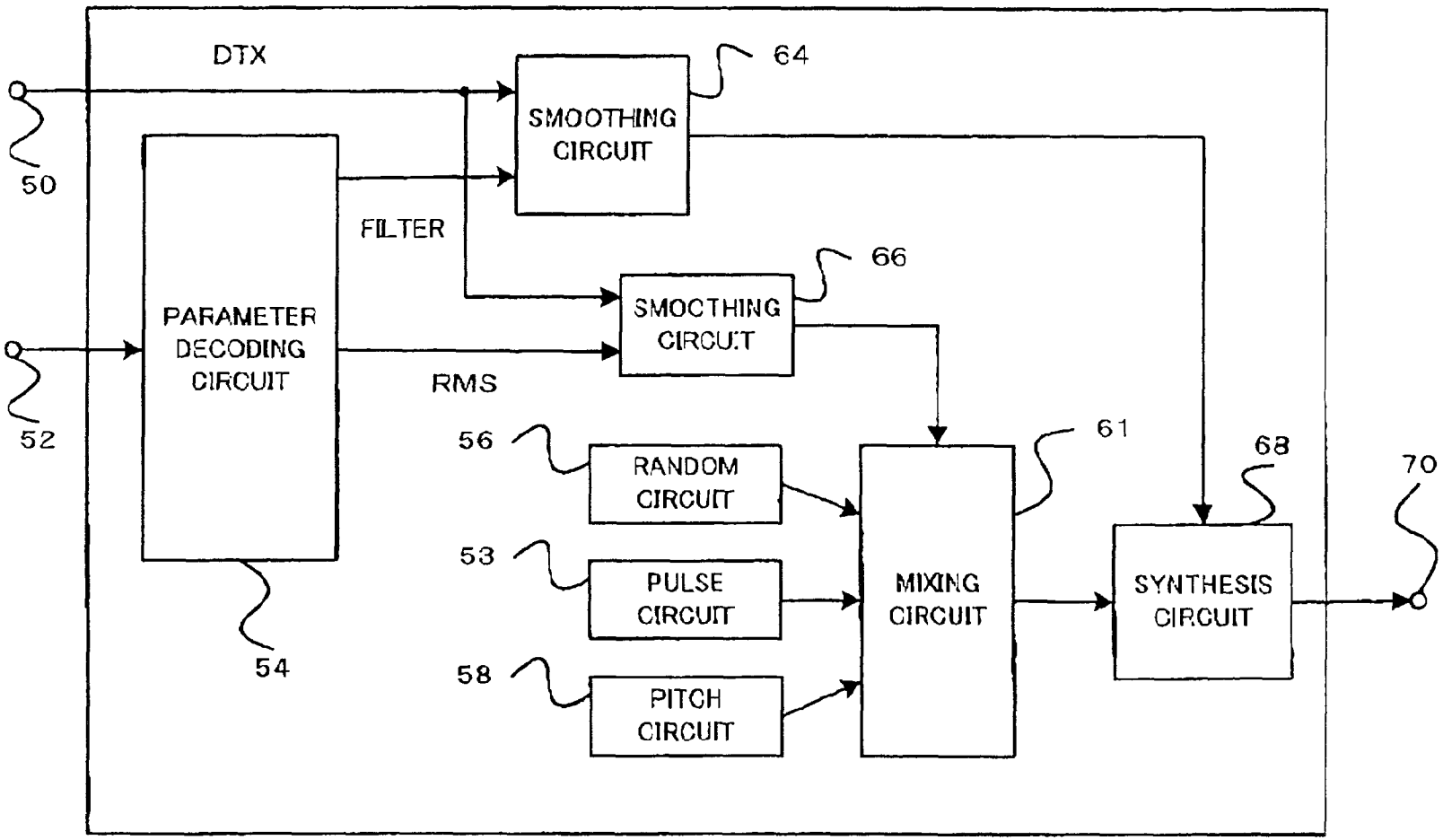
FIG. 1 shows a diagram of a structure of a voice-less part decoding circuit according to a first embodiment of the invention.
Figure 10:
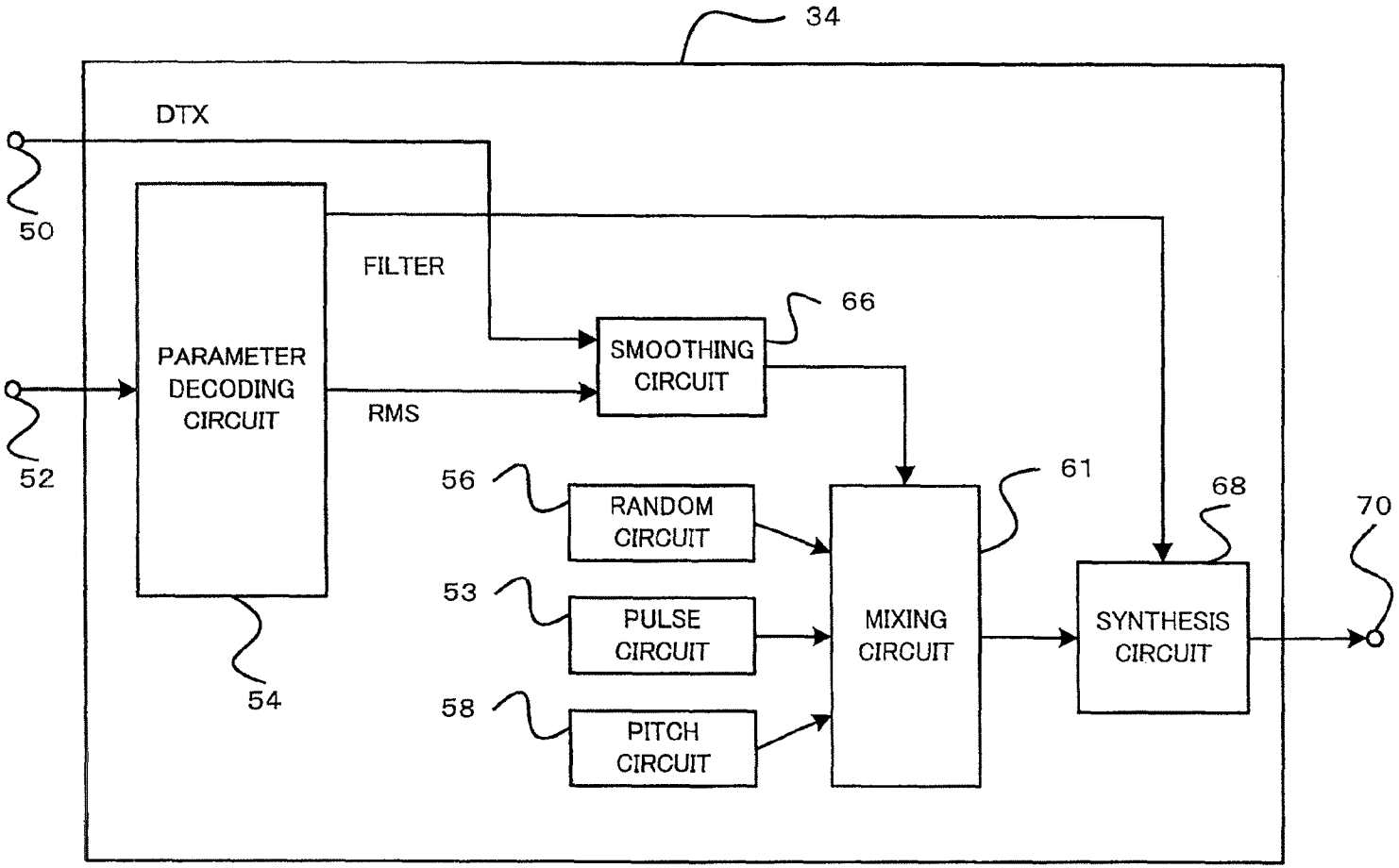
FIG. 10 PRIOR ART
FIG. 10 shows a diagram of a structure of a voice-less part decoding circuit of a conventional decoding device.

FIG. 1 shows a block diagram of a structure of a voice-less part decoding circuit in a decoding device according to the first embodiment of the invention. Referring to FIG. 1, the voice-less part decoding circuit of the first embodiment is different from the voice-less part decoding circuit 34 shown in FIG. 10 in that the former voice-less part decoding circuit further includes a smoothing circuit 64. In the following description, it is mainly explained about the difference between the device according to the invention and the conventional device, therefore, explanation about common parts will be omitted.

A parameter decoding circuit 54 determines the filter coefficients and the RMS by using a sequence of signals received from an input terminal 52, and passes the determined filter coefficient and the determined RMS to the smoothing circuit 64 and the other smoothing circuit 66, respectively.

The smoothing circuit 64 smoothes the filter coefficients received from the parameter decoding circuit 54 and passes the smoothed filter coefficients to the synthesis circuit 68. However, the smoothing circuit 64 performs smoothing process by using the filter coefficients of the past frames when the DTX determination sign received from an input terminal 50 indicates that the feature parameters are received.

Smoothed filter coefficients F(n, i), (i=1, . . . , M) used for the n-th frame from the beginning of each voice-less period, is calculated by using an equation (4) with the filter coefficients f(n, i) (i=1, . . . , M) entered in the n-th frame. Also, in a frame where nothing is transmitted, the filter coefficients sent immediately before the frame are used to calculate instead of f (n, i).

$$F(n,i)=(1-\beta)F(n-1,i)+\beta f(n,i) \quad (4)$$

Herein, β is a smoothing factor to determine a degree of smoothing. Also, F (−1, i), (i=1, . . . , M) is equal to 0.

M is an order of the synthesis filter. The synthesis circuit 68 decodes the signal by feeding an excitation signal received from the mixing circuit 61 into the synthesis filter composed of the filter coefficients received from the smoothing circuit 64, and outputs the decoded signal to an output terminal 70.

FIG. 2 shows a diagram representing a structure of the decoding device according to the second embodiment of the invention. The embodiment differs from the conventional decoding device shown in FIG. 9 in that a structure of a voice-less part decoding circuit 35 of the embodiment is different from that of the conventional decoding device, and the embodiment includes a smoothing control circuit 36. Hereinafter, description is mainly made about the difference between the decoding device according to the second embodiment and the conventional decoding device, and explanation about parts each of which is the same as the corresponding part of the conventional decoding device may be omitted for the sake of convenience.

A bit sequence decomposing circuit 26 decomposes a bit sequence supplied from an input terminal 24 into a VAD determination sign, a DTX determination sign, and a sequence of the encoded signal, and passes the VAD determination sign to a smoothing control circuit 36 and a switching circuit 28, passes the sequence of the signal to the switching circuit 28, and passes the DTX determination sign to a voice-less part decoding circuit 35.

The switching circuit 28 passes the sequence of the signal passed from the bit sequence decomposing circuit 26 to a voice part decoding circuit 30 when the VAD determination sign from the bit sequence decomposing circuit 26 indicates that the input signal is in a voice period, or passes the sequence of the signal to a voice-less part decoding circuit 35 when it indicates that input signal is in a voice-less period.

The smoothing control circuit 36 passes smoothing factors α(n) and β(n) determined based on a change of the VAD determination sign from the bit sequence decomposing circuit 26, to the voice-less part decoding circuit 35. Herein, n represents a frame number, counted from the beginning, of frames in each voice-less period.

For example, when the VAD determination sign indicates that the input signal is in a voice-less period, an effect of a part in a voice period immediately before the voice-less period on the beginning part in the voice-less period can be reduced by setting each of values of the smoothing factors α(n) and β(n) to 1 in the first specified frames or for a specified period in the voice-less period. Further, by setting each of values of the smoothing factors α(n) and β(n) to 1 while a similarly transmitted parameter such as the filter coefficients or the RMS satisfies a specified condition, an effect of a part in a voice period immediately before the voice-less period on the beginning part in the voice-less period can be reduced.

For example, the specified condition is that the RMS is more than a threshold value or that both the RMS and the RMS of the first subframe in the voice-less period are less than a threshold value, for detecting that the RMS is under the influence of the part, in a voice period, immediately before the voice-less period. Also, the specified condition may be that a distance (for example, square distance) between the filter coefficients and a predetermined filter coefficients is less than a predetermined threshold value for detecting that the filter coefficients are similar to a smoothed spectrum in a voice period.

Further, when a voice period immediately before a first voice-less period does not include a certain number of frames or is shorter than a certain length of period, a smoothed value in the last frame of a second voice-less period immediately before the voice period can be used as an initial value P(−1), F(−1, i), (i=1, . . . , M) for calculating smoothed values of the filter coefficients and the RMS, since it is considered that the characteristics of the input signal in the second voice-less period is similar to the characteristics of the input signal in the first voice-less period.

The voice-less part decoding circuit 35 decodes the signal in a voice-less period by using the smoothing factors $\alpha(n)$ and $\beta(n)$, the DTX determination sign received from the bit sequence decomposing circuit 26, and the sequence of the signal received from the switching circuit 28, and outputs the decoded signal to an output terminal 32.

FIG. 3 shows a diagram representing a structure of the voice-less part decoding circuit 35 according to the second embodiment of the invention. The voice-less part decoding circuit 35 is different from the voice-part decoding circuit of the first embodiment of the invention in a structure of a smoothing circuit 49 and a smoothing circuit 51.

A parameter decoding circuit 54 determines the filter coefficients and the RMS based on a sequence of the encoded signal entered from an input terminal 52, and passes the filter coefficients to the smoothing circuit 49 and passes the RMS to the smoothing circuit 51.

The smoothing circuit 49 smoothes the filter coefficients supplied from the parameter decoding circuit 54 by using a smoothing factor $\beta$ (n) entered from an input terminal 65, and passes the smoothed filter coefficients to a synthesis circuit 68. However, when the DTX determination sign received from an input terminal 50 indicates that the encoded signal is not transmitted the filter coefficients of the previous frame is repeatedly used.

The smoothed filter coefficients used in the n-th frame from the beginning of each voice-less period, F (n, i), (i=1, . . . , M) can be calculated by using the following equation (5) which is similar to the above equation (4), with the filter coefficients entered in the n-th frame f(n, i).

$$F(n,i)=(1\beta(n))\cdot F(n-1,i)+\beta(n)\cdot f(n,i) \quad (5)$$

Herein, a value of $\beta(n)$ is changed according to the number of frames which have already received in each voice-less period, and takes about 1 when a few frames are received, so as to remove an effect from the past frames. For example, it can be set as follows.

$\beta(1)=\beta(2)=1.0$, $\beta(3)=\beta(4)=\ldots=\beta(L)=0.7$. Herein, L is the number of frames in each voice-less period.

The smoothing circuit 51 smoothes the RMS sent from the parameter decoding circuit 54 and passes the smoothed RMS to a mixing circuit 61. However, when the DTX determination sign sent from an input terminal 50 indicates that the encoded signal is not transmitted, a smoothing process is performed by using the RMS recently received. The smoothed RMS P(n), which is used in the n-th frame from the beginning of each voice-less period, is calculated by using the following equation (6) which is similar to the equation (1), with the RMS p(n) entered in the n-th frame.

$$P(n)=(1-\alpha(n))\cdot P(n-1)+\alpha(n)\cdot p(n) \quad (6)$$

Herein, similarly to $\beta(n)$, $\alpha(n)$ is changed according to the number of frames which have already received in each voice-less period, and takes about 1 when a few frames are received, so as to remove an effect from the past frames. For example, it can be set as follows.

$\alpha(1)=\alpha(2)=1.0$, $\alpha(3)=\alpha(4)=\ldots=\alpha(L)=0.7$. Herein, L is the number of frames in each voice-less period.

Also, one of the processes of the smoothing circuits 49 and 51 can be performed. In this case, the filter coefficients or the RMS sent from the parameter decoding circuit 54 are or is directly sent to the synthesis circuit 68 or a mixing circuit 61.

In the mixing circuit 61, calculates an excitation signal x(i) to be fed into a synthesis filter by performing the linear sum about a random signal r(i) sent from a random circuit 56, a pulse signal p(i) sent from a pulse circuit 53, and a pitch signal q(i) sent from a pitch circuit 58 with a smoothed RMS sent from the smoothing circuit 51, and passes the calculated signal to the synthesis circuit 68.

The synthesis circuit 68 decodes the speech signal by feeding the excitation signal sent from the mixing circuit 61 into the synthesis filter composed of the filter coefficients sent from the smoothing circuit 49, and outputs the decoded speech signal from an output terminal 70.

FIG. 4 shows a diagram representing a structure of a decoding device according to the third embodiment of the invention. The embodiment differs from the conventional decoding device in a voice-less part examining circuit 38 and a voice-less part decoding circuit 37.

A bit sequence decomposing circuit 26 decomposes a bit sequence supplied from an input terminal 24 into a VAD determination sign, a DTX determination sign, and a sequence of signals, and passes the VAD determination sign and the sequence of signals to a switching circuit 28, and passes the DTX determination sign to a voice-less part decoding circuit 37.

The switching circuit 28 passes the signal passed from the bit sequence decomposing circuit 26 to a voice part decoding circuit 30 when the VAD determination sign from the bit sequence decomposing circuit 26 indicates that the input signal is in a voice period, or passes the sequence of signals to a voice-less part decoding circuit 37 when it indicates that the input signal is in a voice-less period.

The voice-less part examining circuit 38 determines a set up parameter to adjust coupling coefficients of the linear sum used at the mixing circuit 62 shown in FIG. 5 by using the filter coefficients and the RMS sent from the voice-less part decoding circuit 37, and passes the parameters to the voice-less part decoding circuit 37. Description will be made later with a process in the mixing circuit 62 about calculation of the set up parameters.

FIG. 5 shows a diagram representing a structure of the voice-less part decoding circuit 37 according to the third embodiment of the invention. The voice-less part decoding circuit 37 is different from the voice-less part decoding circuit 35 of the first embodiment of the invention in a mixing circuit 62 and an output destination of a parameter decoding circuit 54. Hereinafter, description is made mainly about the difference, and description about the common part is omitted.

A parameter decoding circuit 54 determines the filter coefficients and the RMS based on a sequence of signals entered from an input terminal 52, and passes the filter coefficients to the smoothing circuit 64 and an output terminal 23, and passes the RMS to the smoothing circuit 66 and an output terminal 25.

The smoothing circuit 66 smoothes the RMS passed from the parameter decoding circuit 54 and passes the smoothed RMS to a mixing circuit 62. When the DTX determination sign sent from an input terminal 50 indicates that the encoded signal is not transmitted, the RMS, which is transmitted immediately before the current frame, is used to smooth. Further, it can be controlled not to update the smoothed RMS by setting smoothing factors $\alpha(n)$ and $\beta(n)$ to zero.

A random circuit 56 generates a random number and passes the random number to the mixing circuit 62.

A pulse circuit 53 generates a pulse signal composed of a pulse having a location and an amplitude generated base on the random number, and passes the pulse signal to the mixing circuit 62.

The mixing circuit 62 calculates coupling coefficients of the above-mentioned linear sum by using the set up parameter received from an input terminal 60 and the smoothed RMS received from the smoothing circuit 66.

Also, the circuit 62 calculates a linear sum signal of the random signal from the random circuit 56, the pulse signal from the pulse circuit 53, and the pitch signal from the pitch circuit 58 by using the coupling coefficients, and passes the linear sum signal to the synthesis circuit 68.

The synthesis circuit 68 decodes input signal by feeding an excitation signal sent from the mixing circuit 62 into a filter composed of the filter coefficients sent from the smoothing circuit 64, and outputs the decoded signal from an output terminal 70.

Next, description is made about the voice-less part examining circuit 38 and the mixing circuit 62.

The voice-less part examining circuit 38 determines the characteristics of a background noise in a voice-less part, and changes a calculation method of the coupling coefficients of the pitch signal, the pulse signal, and the random signal in the mixing circuit, according to the determined characteristics. As set up parameters to be changed, there are an order to decide the coupling coefficients or a coupling coefficient $\gamma$.

The voice-less part examining circuit 38 uses information, for example, the RMS and the filter coefficients to determine the characteristics of the background in the voice-less part.

According to a method of controlling the set up parameters based on the above the illustrated information, when the RMS is less than a predetermined threshold value and thereby it is presumed that there is no background noise, or when it is presumed that the input signal is a white noise since an inclination of spectrum of the input signal calculated from the filter coefficients is flat, a contribution rate of the random signal is expanded. It means that a value of $\gamma$ is reduced with keeping the order of calculation of the coupling coefficients.

Also, the set up parameters of the voice-less period can be included in a sequence of signals and transmitted with the signals.

FIG. 6 shows a diagram representing a structure of a decoding device according to the fourth embodiment of the invention. The embodiment differs from the second embodiment of the invention in a voice-less part examining circuit 38 and a voice-less part decoding circuit 39.

A bit sequence decomposing circuit 26 decomposes a bit sequence supplied from an input terminal 24 into a VAD determination sign, a DTX determination sign, and a sequence of signals, and passes the VAD determination sign to a smoothing control circuit 36 and a switching circuit 28, passes the sequence of signals to the switching circuit 28, and passes the DTX determination sign to a voice-less part decoding circuit 39.

The switching circuit 28 passes the sequence of signals passed from the bit sequence decomposing circuit 26 to a voice part decoding circuit 30 when the VAD determination sign from the bit sequence decomposing circuit 26 indicates that the encoded signal is in a voice period, or passes the sequence of signals to a voice-less part decoding circuit 39 when it indicates that input signal is in a voice-less period.

The smoothing control circuit 36 passes the smoothing factors $\alpha$ (n) and $\beta$(n) which are determined according to a change of the VAD determination sign sent from the bit sequence decomposing circuit 26 to the voice-less part decoding circuit 39.

The voice-less part examining circuit 38 determines a set up parameter to adjust coupling coefficients of the linear sum used at the mixing circuit 62 shown in FIG. 7 by using a smoothed RMS sent from the voice-less part decoding circuit 39, and passes the parameters to the voice-less part decoding circuit 39.

The voice-less part detecting circuit 39 can perform a set up parameter determining process by replacing RMS with smoothed RMS in above-mentioned process of the voice-less part examining circuit 38.

The voice-less part detecting circuit 39 decodes an input signal in a voice-less period, by using the DTX determination sign from the bit sequence decomposing circuit 26, the encoded signal from the switching circuit 28, the smoothing factors $\alpha$(n) and $\beta$(n) from the smoothing control circuit 36, and the set up parameters from the voice-less part examining circuit 38, and outputs the decoded signal from an output terminal 32.

Also, smoothed RMS calculated by a smoothing circuit 51 shown in FIG. 7 and smoothed filter coefficients calculated by a smoothing circuit 49 are passed to the voice-less part examining circuit 36.

FIG. 7 shows a diagram representing a structure of the voice-less part decoding circuit 39 according to the fourth embodiment of the invention. The voice-less part decoding circuit 39 is different from the voice-part decoding circuit of the second embodiment of the invention in that in the fourth embodiment, an output from a smoothing circuit 51 is supplied to an output terminal 69 and a smoothing circuit 49 is supplied to an output terminal 63.

In each of the above described embodiments of the invention, a pitch signal, a pulse signal, and a random signal is used to compute an excitation signal of a synthesis filter, but any of them can be omitted.

A decoding device according to the invention and a coding device described in a background section of the specification can be applied to a radio terminal or a radio base station thereby, a radio voice communication system using a speech signal compressing technique can be easily established. Further, a voice terminal can be easily constructed by storing a program to perform the above described decoding method of the invention into a storage medium such as a floppy disk and by loading the program into a personal computer to which a loudspeaker is connected.

As described above, according to the invention, the following effects are obtained.

A first effect of the invention is that speech quality degradation due to discontinuous change of the filter coefficients used in decoding the signal in a voice-less period can be prevented in the decoding device of the invention.

This reason is that the discontinuously transmitted filter coefficient is smoothed and used in the invention.

A second effect of the invention is that a speech quality degradation due to influence of a voice period immediately before a voice-less period on the beginning of the voice-less period can be reduced in the decoding device of the invention.

This reason is that a smoothing factor is adjusted not to smooth the feature parameters in the beginning of a voice-less period.

A third effect of the invention is that auditory discontinuity caused by a transition between a voice period and a voice-less period can be reduced in the decoding device of the invention.

This reason is that when an excitation signal of a reproduction filter is generated in a voice-less period, ratio of a random element to a pulse element and a pitch element is changed according to a nature of input signals.

The invention claimed is:

1. A speech decoding device which decodes speech signals by using received feature parameters representing gain and representing spectral envelope characteristics, the device comprising:

a voice/voice-less detecting circuit for detecting if said speech signals are classified in a period containing voice, denoted as a voice period, or in a period that does not contain voice, denoted as a voice-less period; and a voice-less decoding circuit for intermittently receiving said feature parameter representing spectral envelope characteristics to decode a current frame of the speech signals in said voice-less period, the voice-less decoding circuit performing said decoding by smoothing said feature parameter representing spectral envelope characteristics of said current frame and synthesizing said speech signals of said current frame based on a smoothed feature parameter representing spectral envelope characteristics of said current frame and said feature parameter representing a gain of said current frame, wherein said smoothing is performed by weighting a smoothed feature parameter representing spectral envelop characteristics of an immediately preceding frame and a feature parameter representing special envelope characteristics of said current frame and by adding the weighted smoothed feature parameter representing spectral envelope characteristics of said immediately preceding frame and the weighted feature parameter representing spectral envelope characteristics of said current frame, wherein a value of a weighting factor used in said smoothing is changed according to a number of frames which have been received in prior voice-less periods, and wherein when no feature parameter representing spectral envelope characteristics is received in said current frame, the smoothing is performed using said feature parameter representing spectral envelope characteristics received before the current frame in place of said feature parameter representing spectral envelope characteristics of said current frame.

2. The speech decoding device of claim 1, wherein when a length of a voice period immediately before a first voice-less period is shorter than a predetermined length, a value of a feature parameter which is finally transmitted in a second voice-less period immediately before the voice period is used as an initial value of smoothing.

3. The speech decoding device of claim 1, wherein the feature parameters includes at least one of a quantity representing spectral envelope of the signals to be decoded and a quantity representing power of the signals to be decoded.

4. The speech decoding device of claim 1 being included in a speech coding/decoding device with a coding device which determines whether the input signal is in a voice period or in a voice-less period for each frame and encodes the feature parameters of the input signals to output.

5. The speech decoding device of claim 1, wherein smoothing in a subsequent period is performed even when a new feature parameter is not received.

6. A method of decoding speech signals in a speech decoding device by changing a decoding operation corresponding to received feature parameters representing gain and representing spectral envelope characteristics according to whether the speech signals are classified as a voice period or a voice-less period, the method comprising the acts of:

detecting if said speech signals are classified in a period containing voice, denoted as a voice period, or in a period that does not contain voice, denoted as a voice-less period;

smoothing, by the speech decoding device, said feature parameter representing spectral envelope characteristics of a current frame of the speech signals to be decoded in said the voice-less period, wherein said smoothing is performed by weighting a smoothed feature parameter representing spectral envelope characteristics of an immediately preceding frame and said feature parameter representing spectral envelope characteristics of said current frame and by adding the weighted smoothed feature parameter representing spectral envelope characteristics of said immediately preceding frame and the weighted feature parameter representing spectral envelope characteristics of said current frame, changing a value of a weighting factor used in said smoothing according to a number of frames which have been received in prior voice-less periods, and wherein when no feature parameter representing spectral envelope characteristics is received in said current frame, said smoothing is performed using a feature parameter representing spectral envelope characteristics that was received before the current frame in place of said feature parameter representing spectral envelope characteristics of said current frame; and decoding, by the speech decoding device, the speech signal using the smoothed feature parameter representing spectral envelope characteristics of said current frame and said feature parameter representing a gain of said current frame.

7. The method of claim 6, wherein the feature parameters includes at least one of a quantity representing spectral envelope of the signals to be decoded and a quantity representing power of the signals to be decoded.

8. The method of claim 6, wherein smoothing in a subsequent period is performed even when a new feature parameter is not received.

9. A computer readable non-transitory storage medium which stores a computer executable program performing a method of decoding speech signals by changing a decoding operation corresponding to received feature parameters representing gain and representing spectral envelope characteristics according to whether the speech signals are classified in a period containing voice, denoted as a voice period, or in a period that does not contain voice, denoted as a voice-less period, the computer executable program operable to, when executed by a computer processor, perform the acts of:

detecting if said speech signals are classified as a voice period or a voice-less period;

smoothing said feature parameter representing spectral envelope characteristics of a current frame of the speech signals to be decoded in said voice-less period, wherein said smoothing is performed by weighting a smoothed feature parameter representing spectral envelope characteristics of an immediately preceding frame and said feature parameter representing spectral envelope characteristics of said current frame and by adding the weighted smoothed feature parameter representing spectral envelope characteristics of said immediately preceding frame and the weighted feature parameter representing spectral envelope characteristics of said current frame, wherein a value of a weighting factor used in said smoothing is changed according to a number of frames which have been received in prior voice-less periods, and wherein when no feature parameter for spectral envelope characteristics is received in said current frame, said smoothing is performed using a feature parameter representing spectral envelope characteristics that was received before the current frame in place of said feature parameter representing spectral envelope characteristics of said current frame; and decoding the speech signal using the smoothed feature parameter representing spectral envelope characteristics of said current frame and said feature parameter representing a gain of said current frame.

10. The computer readable storage medium of claim 9, wherein smoothing in a subsequent period is performed even when a new feature parameter is not received.

* * * * *